US011274572B2

(12) United States Patent
Haje et al.

(10) Patent No.: US 11,274,572 B2
(45) Date of Patent: Mar. 15, 2022

(54) STEAM TURBINE WITH FLOW SHIELD

(71) Applicant: Siemens Energy Global GmbH & Co. KG, Munich (DE)

(72) Inventors: Detlef Haje, Gorlitz (DE); Stefan Preibisch, Gorlitz (DE); Manuela Salomo, Kodersdorf (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 489 days.

(21) Appl. No.: 16/326,440

(22) PCT Filed: Jul. 4, 2017

(86) PCT No.: PCT/EP2017/066550
§ 371 (c)(1),
(2) Date: Feb. 19, 2019

(87) PCT Pub. No.: WO2018/036696
PCT Pub. Date: Mar. 1, 2018

(65) Prior Publication Data

US 2021/0310375 A1 Oct. 7, 2021

(30) Foreign Application Priority Data

Aug. 23, 2016 (DE) ..... 10 2016 215 795.7

(51) Int. Cl.
*F01D 25/24* (2006.01)

(52) U.S. Cl.
CPC ..... *F01D 25/24* (2013.01); *F05D 2220/31* (2013.01)

(58) Field of Classification Search
CPC .... F01D 25/24; F01D 25/26; F05D 2230/642; F05D 2220/31; F23M 20/005; F01K 13/006
See application file for complete search history.

(56) References Cited

U.S. PATENT DOCUMENTS 6,227,575 B1 5/2001 Monning et al.
2004/0191488 A1* 9/2004 Berndt ..... C23C 14/042 428/195.1

(Continued)

FOREIGN PATENT DOCUMENTS

CN 85101529 A 1/1987
DE 102008045657 A1 3/2010

(Continued)

OTHER PUBLICATIONS

PCT International Search Report and Written Opinion of International Authority dated Oct. 12, 2017 corresponding to PCT International Application No. PCT/EP2017/066550.

*Primary Examiner* — Shafiq Mian

(57) ABSTRACT

A steam turbine having a turbine housing which has a plurality of turbine housing parts and surrounds a flow space along a turbine longitudinal axis, the turbine housing having a housing wall, a join being formed between two adjacent turbine housing parts. On a side of the housing wall facing the flow space, there is at least one flow shield which shields a wall section of the housing wall from a flow in the flow space. An interstice is formed between the flow shield and the wall section of the housing wall. The interstice has, at least in one region, an opening to the flow space, a fluid-communicating connection of the interstice to the flow space being formed via the opening.

12 Claims, 2 Drawing Sheets

(56) References Cited

U.S. PATENT DOCUMENTS

| | | | | |
|---|---|---|---|---|
| 2010/0054925 | A1* | 3/2010 | Haje | F01D 11/005 415/177 |
| 2010/0135780 | A1* | 6/2010 | David | F01D 5/3046 415/208.1 |
| 2015/0323183 | A1* | 11/2015 | Butcher | F01D 25/243 60/752 |
| 2017/0067355 | A1* | 3/2017 | Vogel | F01D 11/00 |
| 2021/0156283 | A1* | 5/2021 | Leidinger | F01D 1/04 |

FOREIGN PATENT DOCUMENTS

| | | | |
|---|---|---|---|
| EP | 0005616 | A1 | 11/1979 |
| EP | 1162347 | A1 | 12/2001 |
| EP | 2119878 | A1 | 11/2009 |
| GB | 510505 | A | 8/1939 |
| JP | S5390703 | U | 7/1978 |
| JP | S57212307 | A | 12/1982 |
| JP | H04111501 | U | 8/1992 |
| JP | 2001140605 | A | 5/2001 |
| JP | 2002506506 | A | 2/2002 |
| NL | 97874 | C | 4/1961 |
| WO | 9900620 | A1 | 1/1999 |

* cited by examiner

STEAM TURBINE WITH FLOW SHIELD

CROSS REFERENCE TO RELATED APPLICATIONS

This application is the US National Stage of International Application No. PCT/EP2017/066550 filed Jul. 4, 2017, and claims the benefit thereof. The International Application claims the benefit of German Application No. DE 10 2016 215 795.7 filed Aug. 23, 2016. All of the applications are incorporated by reference herein in their entirety.

FIELD OF INVENTION

The present invention relates to a steam turbine having a multipart turbine housing.

BACKGROUND OF INVENTION

Steam turbines are turbomachines which are designed to convert the enthalpy of steam into kinetic energy. Conventional steam turbines have a turbine housing that surrounds a flow space for the steam to flow through. Arranged in the flow space is a rotationally mounted turbine shaft having a multiplicity of rotor blades, which are held in the form of successively arranged rotor blade rings on the turbine shaft. In order to optimize the incident flow of the rotor blades with steam, steam turbines have guide blade rings, which are each connected in front of a rotor blade ring and are held on the turbine housing. A group of a guide blade ring with an associated rotor blade ring is referred to as a turbine stage.

While flowing through the steam turbine, the steam releases some of its internal energy, which is converted via the rotor blades into rotation energy of the turbine shaft. In the process, the steam is expanded, such that the pressure and temperature of the steam are reduced after each turbine stage as it flows through the steam turbine. The turbine housing is thus exposed to a temperature gradient between a steam inlet and a steam outlet. This results, in particular in compact steam turbines, in very high loading of the turbine housing.

In specific embodiments, steam turbines have a high-pressure section and a medium-pressure section and/or low-pressure section. In order to improve the efficiency, such steam turbines can have a heating device for reheating the steam, such that steam leaving for example the high-pressure section is heatable by the heating device before said steam is fed to the downstream turbine sections. Provision can be made here for such a heating device to be arranged in each case between two turbine sections. In particular in steam turbines having such reheating of the steam, large temperature fluctuations arise along a turbine longitudinal axis of the steam turbine. First of all, the temperature drops gradually in the high-pressure section, then increases abruptly in the transition region on account of the reheating. A region of the turbine housing that is arranged next to an outflow of the high-pressure section and an incident flow of the following medium-pressure section or low-pressure section is exposed to particularly large temperature fluctuations in particular in the case of compact steam turbines.

Moreover, for reasons of easier producibility and assemblability, turbine housings have a plurality of housing parts, which are joined together to form the turbine housing, forming parting lines. Turbine housings in this case often have a lower housing part and an upper housing part. Along the turbine longitudinal axis, too, the turbine housing can have a plurality of housing segments, such that the high-pressure section and the medium-pressure section are arranged for example in different housing segments. Joining often takes places via screwing together flanges of the housing parts or housing segments.

The greater the mechanical load on the joints of the housing parts or housing segments, the larger the fastening elements that are required in order to compensate for forces opening the parting lines. In particular in compact steam turbines, this represents a significant problem, since available installation space of the steam turbine is often highly limited. Thus, the loading capacities of these steam turbines are highly limited.

DE 10 2008 045 657 A1 discloses a steam turbine in which a parting line between two housing parts is covered completely by a shield element. The shield element is sealed off from the housing parts via a sealing device, such that a cavity formed between the shield element and the turbine housing is sealed off from the flow space. Via a pressure line, the cavity is connected in a fluid-communicating manner to a downstream region of the flow space in the direction of flow of the steam turbine, said downstream region being arranged after a guide blade support. The pressure line is able to be shut off via a valve. Such a turbine is very complicated and thus costly to produce. Furthermore, the sealing device is exposed to a high mechanical load, in particular thermal load but also abrasion by the flow of steam, and accordingly exhibits a high level of wear. This causes high maintenance effort and high maintenance costs on account of the requisite shutting down and starting up and the long downtimes of the steam turbine that are necessary for maintenance.

SUMMARY OF INVENTION

Therefore, it is an object of the present invention to provide a steam turbine that improves or at least partially improves the above drawbacks. The object of the present invention is in particular to create a compact steam turbine with a multipart housing, which ensures a reduced temperature gradient at the turbine housing by way of simple means and in a cost-effective manner, and thus, while having uniformly dimensioned fastening elements for joining the housing parts, allows a greater steam mass flow and thus also has improved efficiency.

The above object is achieved by the patent claims. Accordingly, the object is achieved by a steam turbine having a turbine housing, having a plurality of turbine housing parts, as claimed. Further features and details of the invention can be gathered from the dependent claims, the description and the drawings.

According to a first aspect of the invention, the object is achieved by a steam turbine that has a turbine housing having a plurality of turbine housing parts, said turbine housing surrounding a flow space along a turbine longitudinal axis. The turbine housing has a housing wall, wherein a parting line is formed between two adjacent turbine housing parts. According to the invention, at least one flow shield is arranged on a side of the housing wall facing the flow space, said flow shield shielding a wall portion of the housing wall from a flow in the flow space. An intermediate space is formed between the flow shield and the wall portion of the housing wall, wherein, in at least one region, the intermediate space has an opening to the flow space. A fluid-communicating connection of the intermediate space to the flow space is formed via this opening.

The turbine housing has advantageously at least two turbine housing parts. Preferably, the turbine housing has a lower housing part and an upper housing part, which are each divided into at least two housing segments along a turbine longitudinal axis. The turbine housing has a housing wall, which is impermeable to steam. A parting line is formed in each case between two adjacent turbine housing parts. Preferably, the turbine housing parts have at least one flange, via which they are joined together, in particular screwed together. As a result of the screwing, adjacent turbine housing parts are pressed together and the parting line is thus sealed. According to the invention, it is advantageous for a sealing device, for example a sealing ring, to be arranged in the parting line.

The turbine housing is formed along the turbine longitudinal axis and in a manner surrounding the latter. Thus, the turbine housing surrounds a flow space. Arranged in a rotationally mounted manner in the flow space is for example a turbine shaft having rotor blade rings. Furthermore, the turbine housing has advantageously at least one guide blade ring, which is assigned in each case to at least one rotor blade ring of the turbine shaft. The flow space is configured for the passage of steam. In this case, the steam is deflected by the guide blades and thus strikes the rotor blades at an optimum incident flow angle.

According to the invention, at least one flow shield is arranged on a side of the housing wall that faces the flow space. The flow shield shields a wall portion of the housing wall from a flow—in particular a steam mass flow—in the flow space. In this case, according to the invention, shielding is understood to mean deflection of the flow such that the steam can strike the shielded wall portion with an altered direction of flow and/or reduced flow rate. In the scope of the invention, shielding does not mean that the wall portion is fully isolated from the steam, such that contact with the steam is no longer possible.

The flow shield is formed advantageously in the form of a plate and as a further advantage is adapted to a curvature of the turbine housing, in order to exert as little influence as possible on the rest of the steam flow flowing through the flow space. Preferably, the turbine housing is configured such that the turbine wall and flow shield form an optimum flow space that is optimized for the incident flow of the turbine stages. For this purpose, the turbine housing has, in the region of the flow shield, advantageously a slight increase in cross section, in order to compensate for a reduction in the flow space volume brought about by the flow shield.

Formed between the flow shield and the housing wall is an intermediate space. Preferably, for this purpose, the flow shield is at least partially spaced apart from the housing wall. For this purpose, it is advantageous for at least one spacer to be arranged between the flow shield and the housing wall. Preferably, the flow shield is screwed to the housing wall, but can also be welded or riveted thereto. A spacer is advantageously in the form of a hollow cylinder that surrounds a screw of the screw connection. The fastening of the flow shield to the housing wall is formed advantageously in a thermally movable manner in order to avoid stresses between the flow shield and housing wall on account of different thermal expansions.

In at least one region, the intermediate space has an opening to the flow space. Via the opening, a fluid-communicating connection of the intermediate space to the flow space is established. It is advantageous for the opening to be formed on a side of the intermediate space that faces in a direction of flow of the steam. Preferably, the intermediate space is closed counter to the direction of flow of the steam. In this way, direct flowing of the steam, flowing in the direction of flow, into the intermediate space is avoided. In order to pass into the flow space, the steam has to change its direction of flow and thus reduce its flow rate. The opening is advantageously in the form of a gap between the flow shield and the housing wall. Alternatively, the opening can be in the form of a bore or channel, in particular in the flow shield. As a result of the opening, steam can pass out of the remaining flow space into the intermediate space. In this way, during operation of the steam turbine, the same temperature or virtually the same temperature and the same pressure or virtually the same pressure can be established in the intermediate space as in the remaining flow space or at the turbine stage in the turbine longitudinal axis portion of which the opening is formed.

Compared with conventional steam turbines, the steam turbine according to the invention has the advantage that a thermal load on the turbine housing is reduced in the region of the flow shield by way of simple means and in a cost-effective manner. A temperature gradient of the housing is thus reduced considerably. In this way, during operation of the steam turbine, fewer stresses are created in the turbine housing, which arise as opening forces at the parting lines. As a result, a maximum loadability and an efficiency of the steam turbine are improvable with an unchanged overall size.

According to a advantageous development of the invention, provision can be made in a steam turbine for the flow shield to extend in the circumferential direction of the housing wall only over a partial circumferential region of the housing wall. In this case, it is advantageous for the flow shield to extend at least at parts of the turbine housing that are exposed to particularly large temperature differences and/or particularly high temperatures compared with other regions of the turbine housing. In this way, it is possible to ensure that the steam turbine has a flow shield only in the regions of the turbine housing that are exposed to a particular thermal load, in order to thus relieve the load on these regions of the turbine housing. It is thus no longer necessary to relieve the load on these regions by reducing the steam mass flow and/or a steam temperature.

It is advantageous for the flow shield to shield the parting line and a region, surrounding the parting line, of the housing wall from the flow. A region around the parting line is a structural weak point of the turbine housing and is particularly susceptible to thermal loading, in particular a high temperature gradient, since, as a result, on account of different thermal expansions, forces that open the parting line can arise at the parting line. Targeted shielding of the parting line and of a region around the parting line thus has the advantage that thermal and mechanical loading of the parting line and of the fastening means that hold the parting line together is reducible in this way with simple means.

As a further advantage, the flow shield extends in the circumferential direction over 1.5 to 6 times a parting line flange height of a parting line flange of the steam turbine. At a parting line, adjacent turbine housing parts each have a parting line flange, via which the turbine housing parts are joined together, for example screwed together. The parting line flange has a parting line flange height in the longitudinal direction of a connecting screw for joining the parting line flanges. In the region of the parting line flange, thermal loading of the turbine housing is particularly disadvantageous. In order to reduce the production costs of the steam turbine and at the same time to ensure good shielding of the parting line flanges, it has been shown that it is particularly advantageous for the flow shield to extend over 1.5 to 6 times the parting line flange height for this purpose.

Preferably, the flow shield has at least two flow shield parts, which are arranged on adjacent turbine housing parts. The flow shields are thus each held on other turbine housing parts and can be mounted on the turbine housing parts easily before the turbine housing is assembled. This improves assemblability of the steam turbine. Furthermore, it is advantageous for the flow shields to be arranged on the turbine housing parts such that, with the turbine housing assembled, at least two flow shields together form a joint flow shield.

It is furthermore advantageous for the flow shield to be arranged in a region of the flow space in which the flow space has a maximum temperature gradient. In these regions of the flow space, loading of the turbine housing on account of different thermal expansions is particularly great. As a result of the flow shield, these regions are relieved of load by a reduced application of temperature and associated lower thermal expansion.

According to the invention, provision can be made for the flow shield to have an end region in the direction of flow, wherein the intermediate space has a reduced height in the end region. Accordingly, the intermediate space has different heights along the flow shield. The opening is formed in the end region and consequently has an opening height that corresponds to the height of the intermediate space in the end region. Such a flow shield is easy to produce and has the further advantage that impinging of the steam from the remaining flow space into the intermediate space is reduced by the lower height of the intermediate space. In this way, only reduced heat exchange can take place at the housing wall in the region of the flow shield. The housing wall is thus relieved of load better.

As a further advantage, the steam turbine has at least one steam feed, which is configured to directly feed steam into the intermediate space. The steam feed can be in the form for example of a channel in the housing wall or of an independent line. Preferably, the steam feed is arranged in such a way as to guide steam to as close as possible to the parting line before it can spread out within the intermediate space. Via a corresponding nozzle, the steam is introducible into the intermediate space for example in the direction of the parting line. Alternatively or additionally, a steam inlet of the steam feed is arranged next to the parting line. The steam feed is advantageously configured to feed steam at a higher temperature than the steam in the flow space at the flow shield. Such a steam feed has the advantage that the temperature gradient at the turbine housing is reducible further by way of simple means. The turbine housing is thus exposed to less loading and so for example a less loadable or more cost-effective turbine housing can be used for the steam turbine. Alternatively, it is possible to increase the action of steam, for example a steam mass flow and/or steam temperature, on the steam turbine, and in this way the efficiency of the steam turbine can be improved.

In an advantageous configuration of the invention, provision can be made for the steam feed to connect a region of the flow space that is arranged upstream of the flow shield in the direction of flow to the intermediate space in a fluid-communicating manner. This means according to the invention in particular a region of the steam turbine that is arranged one turbine stage upstream of the flow shield, i.e. an adjacent region. This has the advantage that, during operation of the steam turbine, steam that is already present is feedable into the intermediate space at an optimum or virtually optimum temperature and an optimum or virtually optimum pressure for feeding. The steam therefore does not have to be provided separately or be delivered over relatively long distances. As a result, operating costs of the steam turbine can be lowered further.

It is advantageous for the steam feed to have at least one control member for setting a steam mass flow. The control member is in the form for example of a valve. Settability of the steam mass flow has the advantage that a temperature transition to the turbine housing is controllable in the region of the flow shield. If for example it is found, in particular by means of an infrared camera, that the turbine housing is too cold in the region of the flow shield, the control member can be opened and thus the steam mass flow that passes into the intermediate space can be increased. Equally, the control member can be at least partially closed when the turbine housing has too high a temperature in the region of the flow shield, in order to throttle the steam mass flow and thus to reduce a temperature exchange with the housing wall. For this purpose, according to the invention, the steam engine can have a regulating device. Preferably, the control member is configured to completely stop the steam mass flow.

Preferably, a side of the flow shield that faces the housing wall has at least one guide element, which is configured to guide a steam mass flow within the intermediate space. The guide element can be in the form for example of a wall that extends advantageously between the housing wall and flow shield and is advantageously in contact with both the housing wall and the flow shield along its course. The guide element can be in the form for example of a diverting element for diverting the steam mass flow once. Alternatively, the guide element is formed for example in a labyrinthine manner. Preferably, the guide element is configured in such a way as to divert the steam mass flow in the direction of the parting line. A guide element has the advantage that a direction of flow of the steam mass flow in the intermediate space is definable in order to optimize heat exchange between the steam mass flow and the housing wall. Furthermore, by means of the guide element, the steam mass flow passed into the intermediate space can be guided in a direction in which heating by the steam mass flow is particularly advantageous, for example in a region around a parting line.

It is advantageous for the flow shield to have a lower coefficient of thermal conductivity than the turbine housing. This is advantageous in particular in the case of large temperature differences of the turbine stage downstream of which the flow shield is arranged. Via the flow shield, heat exchange with the intermediate space is thus reduced and the thermal load on the housing wall is relieved as a result.

BRIEF DESCRIPTION OF THE DRAWINGS

A steam turbine according to the invention having a flow shield is explained in more detail in the following text with reference to drawings, in which, in each case schematically.

DETAILED DESCRIPTION OF INVENTION

Figure 1:
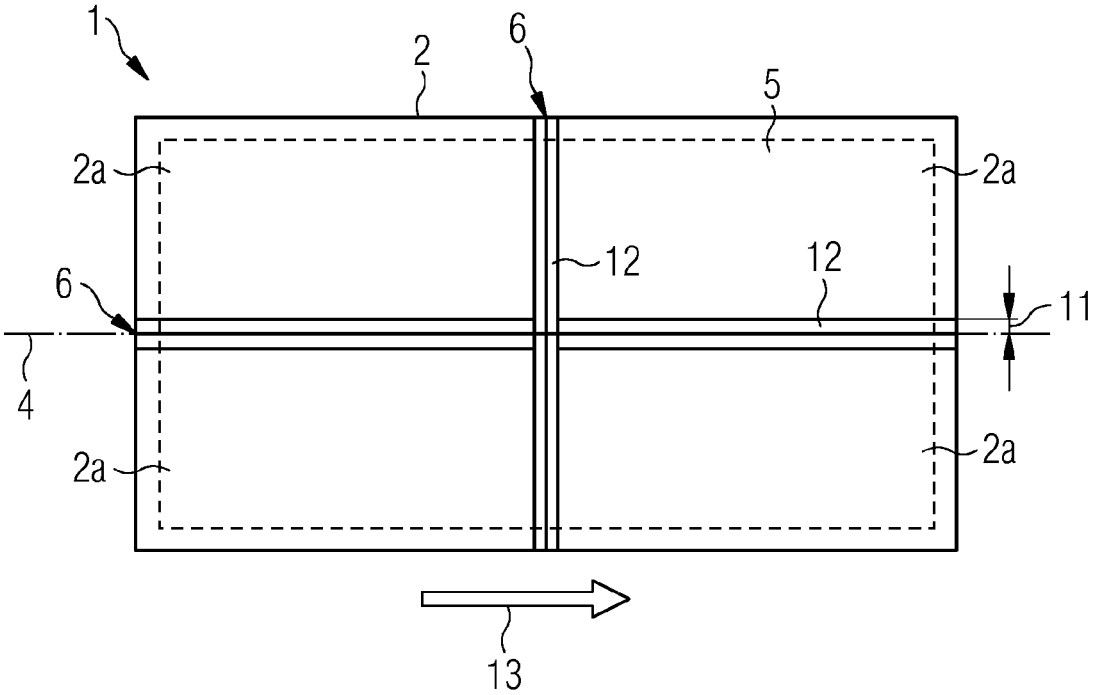
FIG. 1 shows a side view transversely to the direction of flow of a advantageous embodiment of a steam turbine according to the invention.

FIG. 1 schematically illustrates a advantageous embodiment of a steam turbine 1 according to the invention in a side view transversely to a direction of flow 13 of a working fluid or of a steam mass flow of the steam turbine 1. The steam turbine 1 has a turbine longitudinal axis 4 extending in the direction of flow 13, and a turbine housing 2 that is assembled from four turbine housing parts 2*a*. The turbine housing parts 2*a* each have a parting line flange 12 extending in the direction of flow 13 and a parting line flange 12 extending in the circumferential direction around the turbine longitudinal axis 4, said parting line flanges 12 having a parting line flange height 11. The turbine housing parts 2*a* are screwed together via the parting line flanges 12. Formed in each case between two screwed-together parting line flanges 12 is a parting line 6. The turbine housing 2 has a housing wall 5, which extends over the turbine housing parts 2*a*. The turbine housing 2 surrounds a flow space 3 for the passage of the working fluid or steam mass flow.

Figure 2:
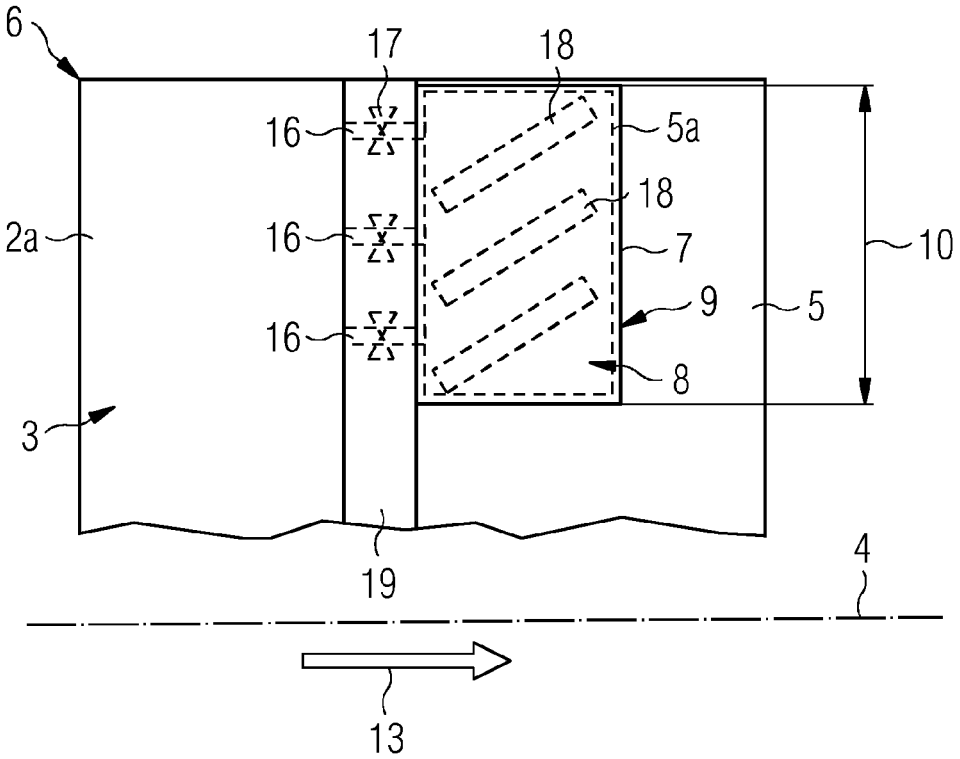
FIG. 2 shows a side view transversely to the direction of flow of a detail of the steam turbine from FIG. 1.

FIG. 2 shows a detail of a lower part of the steam turbine 1 from FIG. 1 in a cross-sectional illustration. Arranged on a wall portion 5*a* of the housing wall 5, next to a parting line 6 extending parallel to the turbine longitudinal axis 4, is a flow shield 7 that the wall portion 5*a* from the rest of the flow space 3. The flow shield 7 extends in the circumferential direction of the steam turbine 1 over a partial circumferential region 10. Preferably, a flow shield 7 is likewise arranged in a corresponding manner on an upper part (not shown in this depiction) of the steam turbine 1. Formed between the flow shield 7 and the wall portion 5*a* is an intermediate space 8. In the direction of flow 13, the intermediate space 8 is connected to the flow space 3 in a fluid-communicating manner via an opening 9. The flow shield 7 is arranged directly downstream of a guide blade support 19 in the direction of flow 13. Arranged in the guide blade support 19 are a plurality of steam feeds 16 for feeding a steam mass flow into the intermediate space 8. In this way, steam is feedable to the intermediate space 8 from the flow space 3 from a region upstream of the guide blade support 19. In order to control the steam mass flow, the steam feeds 16 each have a control member 17. Arranged between the flow shield 7 and the wall portion 5*a* are a plurality of guide elements 18, in order to deflect the steam mass flow fed via the steam feeds 16 or to guide same in the direction of the parting line 6. Via the opening 9, steam exchange can take place between the intermediate space 8 and the flow space 3.

Figure 3:
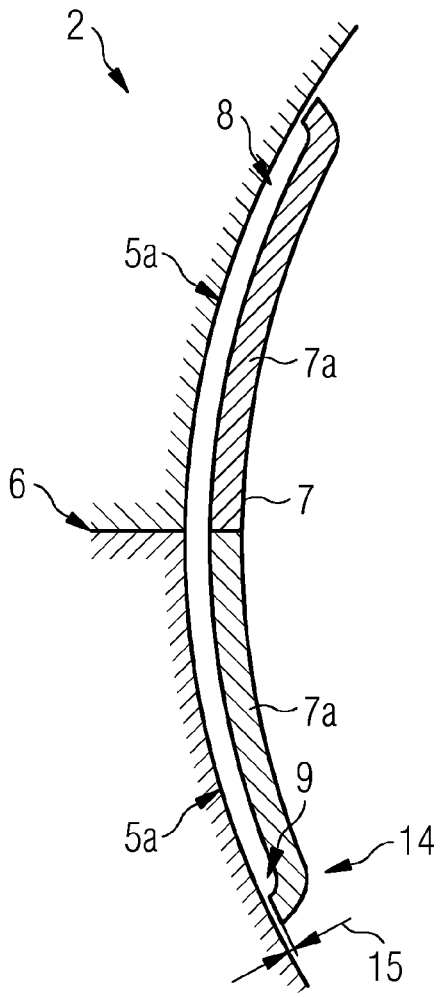
FIG. 3 shows a side view in the direction of flow of a detail of the turbine housing in an alternative embodiment of a steam turbine according to the invention.

FIG. 3 depicts a detail of the turbine housing 2 of the steam turbine 1 in a side view and in the direction of flow 13. In this view, the intermediate space 8 formed between the flow shield 7 and the wall portion 5*a* is clearly visible. The flow shield 7 is formed from two shield parts 7*a*, wherein in each case one shield part 7*a* is arranged on a turbine housing part 2*a*, for example on an upper housing part and a lower housing part. A parting line 6 formed between the turbine housing parts 2*a* is clearly visible in this view. In this embodiment, the intermediate space 8 has an opening 9 that faces downward. In the region of the opening 9, the intermediate space has a height 15 that is less than in the remaining regions of the intermediate space 8.

The invention claimed is:

1. A steam turbine, comprising:

a turbine housing having a plurality of turbine housing parts, said turbine housing surrounding a flow space along a turbine longitudinal axis, wherein the turbine housing has a housing wall, wherein a parting line is formed between two adjacent turbine housing parts, and at least one flow shield arranged on a side of the housing wall facing the flow space, said flow shield shielding a wall portion of the housing wall from a flow in the flow space, wherein an intermediate space is formed between the flow shield and the wall portion of the housing wall, wherein, in at least one region, the intermediate space has an opening to the flow space, wherein a fluid-communicating connection of the intermediate space to the flow space is formed via the opening, wherein the flow shield extends in a circumferential direction of the housing wall only over a partial circumferential region of the housing wall.

2. The steam turbine as claimed in claim 1, wherein the flow shield shields the parting line and a region, surrounding the parting line, of the housing wall from the flow.

3. The steam turbine as claimed in claim 2, wherein the flow shield extends in the circumferential direction over 1.0 to 6.0 times a parting line flange height of a parting line flange of the steam turbine.

4. The steam turbine as claimed in claim 1, wherein the flow shield has at least two flow shield parts, which are arranged on adjacent turbine housing parts.

5. The steam turbine as claimed in claim 1, wherein the flow shield is arranged in a region of the flow space in which the flow space has a maximum temperature gradient.

6. The steam turbine as claimed in claim 1, wherein the flow shield has an end region in a direction of flow, wherein the intermediate space has different heights along the flow shield and a point of a reduced height in the end region.

7. The steam turbine as claimed in claim 1, wherein the steam turbine has at least one steam feed, which is configured to directly feed steam into the intermediate space.

8. The steam turbine as claimed in claim 7, wherein the steam feed connects a region of the flow space that is arranged upstream of the flow shield in a direction of flow to the intermediate space in a fluid-communicating manner.

9. The steam turbine as claimed in claim 7, wherein the steam feed has at least one control member for setting a steam mass flow.

10. The steam turbine as claimed in claim 1, wherein a side of the flow shield that faces the housing wall has at least one guide element, which is configured to guide a steam mass flow within the intermediate space.

11. The steam turbine as claimed in claim 1, wherein the flow shield has a lower coefficient of thermal conductivity than the turbine housing.

12. The steam turbine as claimed in claim 3, wherein the flow shield extends in the circumferential direction over 2.0 to 4.0 times the parting line flange height of the parting line flange of the steam turbine.

* * * * *